US007998328B2

(12) United States Patent
Feng et al.

(10) Patent No.: US 7,998,328 B2
(45) Date of Patent: Aug. 16, 2011

(54) METHOD AND APPARATUS FOR SEPARATING PARTICLES BY DIELECTROPHORESIS

(75) Inventors: Jianjun Feng, Huntsville, AL (US); Guiren Wang, Huntsville, AL (US); Sivaramakrishnan Krishnamoorthy, Madison, AL (US); Kapil Pant, Huntsville, AL (US); Shivshankar Sundaram, Madison, AL (US)

(73) Assignee: CFD Research Corporation, Huntsville, AL (US)

( * ) Notice: Subject to any disclaimer, the term of this patent is extended or adjusted under 35 U.S.C. 154(b) by 1047 days.

(21) Appl. No.: 11/167,428

(22) Filed: Jun. 27, 2005

(65) Prior Publication Data

US 2006/0290745 A1 Dec. 28, 2006

(51) Int. Cl.
*B03C 5/02* (2006.01)

(52) U.S. Cl. ..... 204/643; 204/450; 204/600; 204/547

(58) Field of Classification Search ..... None
See application file for complete search history.

(56) References Cited

U.S. PATENT DOCUMENTS

| | | | | |
|---|---|---|---|---|
| 5,454,472 | A | 10/1995 | Benecke et al. | |
| 6,056,861 | A | 5/2000 | Fuhr et al. | |
| 6,310,309 | B1 | 10/2001 | Ager et al. | |
| 6,492,175 | B1 | 12/2002 | Muller et al. | |
| 6,540,895 | B1 | 4/2003 | Spence et al. | |
| 6,641,708 | B1 * | 11/2003 | Becker et al. | 204/547 |
| 6,663,757 | B1 * | 12/2003 | Fuhr et al. | 204/450 |
| 6,749,736 | B1 | 6/2004 | Fuhr et al. | |
| 6,936,151 | B1 * | 8/2005 | Lock et al. | 204/547 |
| 7,029,564 | B1 * | 4/2006 | Lock et al. | 204/643 |
| 7,294,249 | B2 * | 11/2007 | Gawad et al. | 204/547 |
| 2006/0177815 | A1 * | 8/2006 | Soh et al. | 435/4 |

OTHER PUBLICATIONS

Kim, Byoung-Gyun, Kwang-Seok Yun, and Euisik Yoon. "Active Positioning Control of Single Cell/Microbead in a Micro-Well Array Chip by Dielectrophoresis." MEMS 2005 Miami Technical Digest. Proc. of 18th IEEE International Conference on Microelectromechanical Systems, Miami Beach, FL. 702-05.*

Albrecht et al.(2004) "Geometric and Materials Determinants of Patterning Efficiency by Dielectrophoresis" Biophysical Journal 87:2131-2147.

Fu et al. (2003) "Low-voltage driven control in electrophoresis microchips by traveling electric field" Electrophoresis 24:1253-1260.

Gascoyne et al. (2004) "Dielectrophoresis-Based Sample Handling in General-Purpose Programmable Diagnostic Instruments" Proceedings of the IEEE 92(1):22-42.

Gascoyne et al. (2004) "Microfluidic approaches to malaria detection" Acta Topica 89:357-369.

(Continued)

*Primary Examiner* — Nam X Nguyen
*Assistant Examiner* — Kourtney R Salzman
(74) *Attorney, Agent, or Firm* — Tomas Friend

(57) ABSTRACT

Methods and apparatus for the micro-scale, dielectrophoretic separation of particles are provided. Fluid suspensions of particles are sorted and separated by dielectrophoretic separation chambers that have at least two consecutive, electrically coupled planar electrodes separated by a gap in a fluid flow channel. The gap distance as well as applied potential can be used to control the dielectrophoretic forces generated. Using consecutive, electrically coupled electrodes rather than electrically coupled opposing electrodes facilitates higher flow volumes and rates. The methods and apparatus can be used, for example, to sort living, damaged, diseased, and/or dead cells and functionalized or ligand-bound polymer beads for subsequent identification and/or analysis.

17 Claims, 8 Drawing Sheets

OTHER PUBLICATIONS

Huang et al. (2003) "Separation of Simulants of Biological Warefare Agents from Blood by a Miniaturized Dielectrophoresis Device" Biomedical Microdevices 5(3): 217-225.
Mueller et al. (2003) "The Potential of Dielectrophoresis for Single-Cell Experiments" IEEE Engineering in Medicine and Biology Magazine 22(6):51-61.
Seger et al. (2004) "Cell immersion and cell dipping in microfluidic devices" Lab Chip 4:148-151.
Wong et al. (2004) "Electrokinetics in Mico Devices for Biotechnology Applications" IEEE/ASME Transactions on Mechatronics 9(2): 366-376.

* cited by examiner

METHOD AND APPARATUS FOR SEPARATING PARTICLES BY DIELECTROPHORESIS

STATEMENT REGARDING FEDERALLY SPONSORED RESEARCH OR DEVELOPMENT

Statement of Government Rights

The U.S. Government may have certain rights in this invention pursuant to SBIR Contract Numbers M67854-03-C-5015 and M67854-04-C-5020 awarded by the Marine Corps Systems Command.

CROSS-REFERENCE TO RELATED APPLICATIONS

Not Applicable

INCORPRATED-BY-REFERENCE OF METARIAL SUBMITTED ON A COMPACT DISC

Not Applicable

BACKGROUND OF THE INVENTION

1. Field of the Invention

This invention relates to microfluidic systems for handling or processing fluid suspensions of dielectric particles including living cells, spores, viruses, polymer beads, and aggregates of macromolecules. In particular, the invention involves the use of dielectrophoresis (DEP) induced forces to manipulate or control the velocity, including direction, of dielectric particles in microfluidic devices. The invention can be employed in a wide variety of applications including, but not limited to, the processing, separation and/or concentration of analyte mixture components containing living, non-living, transformed, and/or malfunctioning cells, polymer beads, bacterial or fungal spores, and macromolecules. This invention is capable of separating and concentrating particles based on particle size as well as the electrical properties of the particles.

2. Description of Related Art

The manipulation of particulate fluid suspensions in microfluidic systems, including suspensions of cells and microbes, by applied dielectrophoresis (DEP) forces is known in the art. Reviews of dielectrophoretic manipulation and separation of particles in a microfluidic environment are presented in the following references: GASCOYNE et al. (2004) "Dielectrophoresis-Based Sample Handling in General-Purpose Programmable Diagnostic Instruments" Proceedings of the IEEE 92(1):22-42; MÜLLER et al. (2003) "The Potential of Dielectrophoresis for Single-Cell Experiments" IEEE Engineering in Medicine and Biology Magazine 22(6):51-61; and WONG et al. (2004) "Electrokinetics in Micro Devices for Biotechnology Applications" IEEE/ASME Transactions on Mechatronics 9(2): 366-376, which are incorporated by reference in their entirety.

The direction and magnitude of DEP forces acting on suspended particles depend on particle size, the electric properties of the particles and suspending fluid (medium), and the magnitude, frequency, and waveform of the imposed electric field. The magnitude of the imposed electric field depends on the applied voltage and distance between electrodes. Two types of DEP forces act on particles: (a) conventional DEP (c-DEP) forces that are proportional to the gradient of the electric field strength, and (b) traveling wave DEP (tw-DEP) forces that are proportional to the gradient of the phase of an applied Alternating Current (AC) electric field signal. A c-DEP force tends to move particles to regions where an electric field is either at a minimum (negative DEP) or maximum (positive DEP), depending on the frequency of the signal, and the material properties of the suspending fluid and particles. A Direct Current (DC) electric field is sufficient to induce c-DEP forces while a phase-alternating AC field is required to induce tw-DEP. Accordingly, multiple electrodes must be used to generate tw-DEP. The theoretical foundations of DEP forces and their quantitative descriptions can be found in "Electromechanics of Particles" by Thomas B. Jones, published in 1995 by Cambridge University Press. DEP forces generated by applying DC and AC fields to a pair of interdigitated electrodes located at the bottom of a separation chamber are described by FENG et al. (2002) "Numerical and Analytical Studies of AC Electric Field in Dielectrophoretic Electrode Arrays" Proceedings of the 2002 International Conference on Computational Nanoscience and Nanotechnology, 2:85-88.

A particle experiences conventional DEP forces when a non-uniform electric field is established in the suspending medium upon energizing the electrodes with a DC and/or AC electric field. These c-DEP forces have two components: a normal component that levitates the particle in a direction normal to the electrode surfaces and a horizontal (lateral) component that pushes the particle away from electrodes. Both components of c-DEP forces decrease significantly as the particle is moved away from the electrode.

Conventional microfluidic DEP systems may be exemplified by GASCOYNE and VYKOUKAL (2004) Proceedings of the IEEE 92(1):22-42), U.S. Pat. No. 6,310,309 B1 (AGER et al.), and U.S. Pat. No. 6,749,736 B1 (FUHR et al.), which are incorporated by reference in their entirety. Each of these systems suffers from one or more disadvantages relating to their durability, capacity, and/or functional flexibility with regard to programmability and multipurpose functionality, for example.

The present invention uses arrangements of electrodes that have been designed based on high-fidelity, ab initio physics-based simulations. The electrode arrangement designs have been used to fabricate and engineer microfluidic devices that achieve programmable, high efficiency particle separations at relatively high fluid flow rates. The electrodes are arranged to provide high DEP forces using voltages that do not damage living cells, for example, and permit larger channel dimensions and higher flow volumes than existing microfluidic DEP devices. The present invention also encompasses high throughput systems in which separation chambers are arranged in parallel or series and higher efficiency systems in which samples are recycled through one or more separation chambers.

BRIEF SUMMARY OF THE INVENTION

The present invention represents an advance in the art of dielectrophoretic manipulation of particles in a microfluidic environment. Specifically, particles are separated in a separation chamber comprising at least one pair or preferably two opposing pairs of electrodes that generate c-DEP forces, which act on a mixture of particles in a suspending medium. Particles are deflected and/or blocked by DEP forces generated by the combination of two or preferably four electrodes. Particles deflected by the two pairs of electrodes can be shunted into a side channel for further concentration and analysis. Alternatively, particles blocked by two pairs of electrodes can be released by changing the applied c-DEP forces. The separation chamber can be easily tuned to trap/separate different types of particles by altering the voltages, AC frequencies, and/or the spacing between electrode pairs, for example.

The present apparatus and method allow several target analytes to be discriminated and isolated simultaneously in a single step operation or in multiple steps (by performing a recycling operation, for example) with properly controlled electric fields. Devices using this method can be operated in any orientation or even in a microgravity environment under continuous, stopped-flow, or batch operating conditions.

One of the limitations of conventional microfluidic DEP sorting devices derives from the arrangement and operation of the electrodes used to generate electric fields and the resulting dielectric forces. Systems such as those exemplified by FUHR et al. use electrically coupled electrodes that lie on opposite sides of the flow channel. Since the strengths of the electric fields and DEP forces are limited by cross-sectional dimensions, for example the depth of the channel, and the electrode gap, the sample processing rates of the flow channels using such electrode arrangements are limited. Although increasing the potentials applied to the electrodes may be increased to overcome these challenges, such compensation is severely limited because high potentials damage or kill living cells and, at high voltages, cause electrochemical reactions at the electrode surface and/or result in bubble formation.

One of the key distinctions between the present separation chamber and the devices described by FUHR et al. is the electric coupling of consecutive, coplanar electrodes in the walls of the flow chamber. In the simplest configuration, two sequential, electrically coupled electrodes separated by a gap distance form part of the bottom inner surface of the flow chamber. In another configuration, two pairs of electrically coupled electrodes are placed in opposition to one another across a flow chamber. The electric signals applied to the two pairs of electrodes can be in-phase or out-of-phase using the same or different field strengths. The strengths of the electric field and resulting dielectric forces are inversely proportional to the gap distance between the electrodes. The strength of the electric field generated by the electrodes can be increased by placing the electrodes closer to one another (reducing the gap distance) without increasing the voltage applied to the electrodes. The cross sectional dimensions of the flow chamber need not be reduced to increase the electric field strength so the flow rate through the separation chamber need not be reduced.

The separation mechanism at work in the present invention is also an improvement over that involved in conventional particle handling devices. The present invention takes advantage of both lateral and normal components, whereas conventional devices such as in Field Flow Fractionation (FFF) only use DEP forces normal to the electrode surfaces. The lateral DEP forces of the present invention are used to push particles in the direction of a side channel, for example, rather than relying on hydrodynamic forces. Separation using the present invention may be further enhanced in some instances by using more sophisticated electrode shapes such as parabolic, hyperbolic or other curved shapes, where lateral component can be maximized for further improvement in separation efficiency and/or resolution.

An underlying principle behind the invention is the novel arrangement of electrodes in which a pair of consecutive, electrically coupled, planar electrodes is placed at the bottom surface of a flow channel. The DEP force generated by the pair of electrodes levitates selected particles and can be used to prevent them from traversing the electrodes or to divert them into a side channel. The lateral component of the DEP force can be used to enhance the motion of particles into a side channel. The magnitudes of the levitating and lateral forces used to capture and/or divert particles decrease as distance from the coupled electrode pair increases, at the bottom of the flow channel, for example. An additional pair of consecutive, electrically coupled planar electrodes can be placed above the fluid flow opposite the electrode pair below the fluid flow. Opposing electrode pairs allow for higher flow volumes because the height of the flow channel can be increased while maintaining the same DEP forces without increasing the potential applied to the electrodes. Alternatively, the opposing electrode pairs configuration can be used to strengthen the DEP forces relative to the single electrode pair configuration. Also, levitation of selected particles with only one, bottom pair of electrodes may cause some of the particles to contact the top of the fluid flow channel, which may damage particles such as living cells or cause particles to adhere to the flow channel surface. The DEP forces generated by the opposing electrode pairs produce counterbalanced levitating forces, thereby preventing selected particles from contacting the walls of the flow channel.

The invention is described in more detail below. Those skilled in the art will recognize that the examples and embodiments described are not limiting and that the invention can be practiced in many ways without deviating from the inventive concept.

DETAILED DESCRIPTION OF THE INVENTION

In a first embodiment, the invention comprises a separation chamber comprising a pair of consecutive, electrically coupled, planar electrodes forming a part of the bottom, inner surface a fluid flow channel. The separation chamber may additionally comprise one or more side channels that are capable of transporting fluid and fluid suspensions from the flow channel to a side outlet. The side channels may have cross-sectional areas and geometries different from the cross-sectional areas and geometries of the fluid flow channel.

In a second embodiment, the invention comprises a separation chamber comprising two opposing pairs of consecutive, electrically coupled, planar electrodes that form parts of the top and bottom inner surfaces of a fluid flow channel. The separation chamber may additionally comprise one or more side channels that are capable of transporting fluid and fluid suspensions from the flow channel to a side outlet. The side channels may have cross-sectional areas and geometries different from the cross-sectional areas and geometries of the fluid flow channel.

A third embodiment includes multiple combinations of electrode pairs and multiple side channels in a single separation chamber. A fourth embodiment includes multiple separation chambers in parallel or in series within a single separation apparatus. Fluid flow channels and side channels can have any cross sectional geometry, including square, rectangular, trapezoidal, circular or curved.

Electrically coupled electrode pairs are connected to one or more power source and the electrodes of the pair have opposite potentials at any given time. The potential applied to an electrode pair can be one of the following:

(a) a constantly applied direct electric field (DC field) characterized by the magnitude of applied voltage;

(b) a time varying, direct electric filed (DC) characterized by the magnitude, frequency, and waveform of the applied voltage, and a having a waveform that can be sinusoidal, square, pulse, saw-toothed, or combination thereof; and (c) an alternating electric field (AC field) characterized by the magnitude, frequency, and waveform of the applied voltage and a waveform that can be sinusoidal, square, pulse, saw-toothed or combination thereof.

Figure 1:
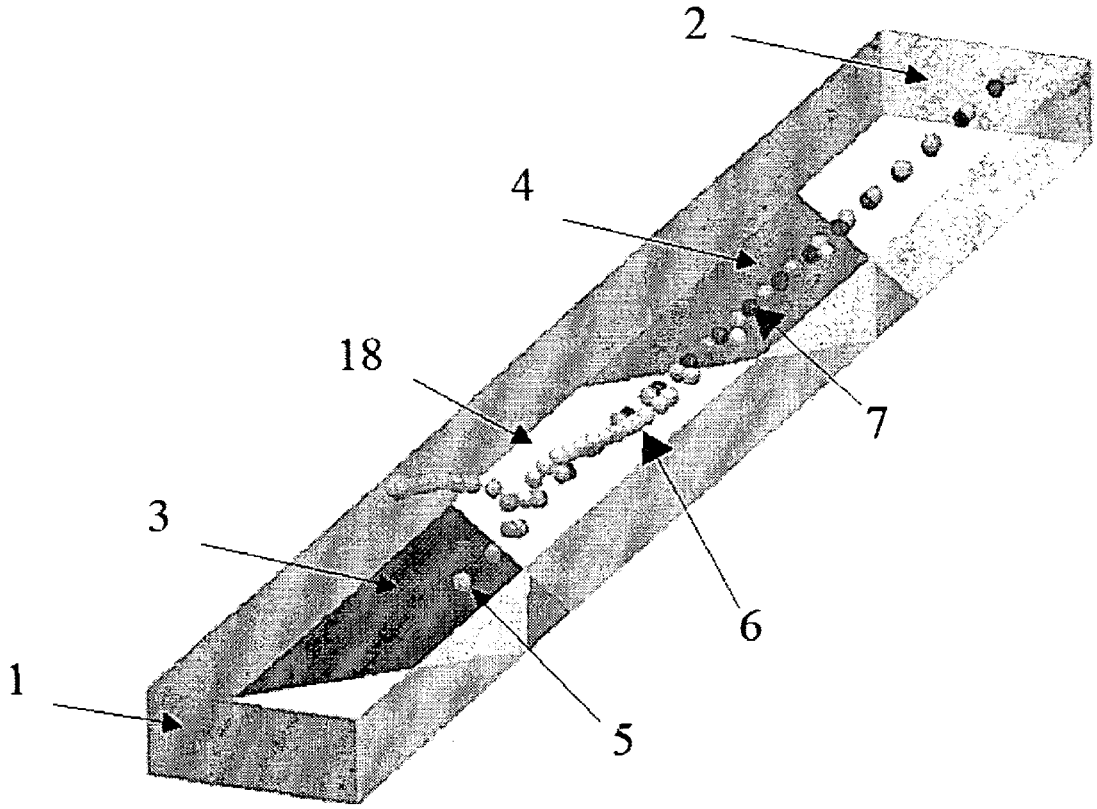
FIG. 1 shows the separation of particles according to size by trapping a subset of particles between two electrodes in a separation chamber.

FIG. 1 depicts one embodiment of the invention. The separation chamber has a rectangular cross section and comprises inlet 1, outlet 2, and electrically coupled electrodes 3 and 4. In this instance the coupled electrodes are wedge-shaped and the gap distance 18 is not constant along the bottom of the channel. Voltage applied to electrodes 3 and 4 generates an electric field that creates a c-DEP force with vertical and horizontal components. Direct (DC) or alternating (AC) voltages may be applied to the electrodes. The vertical component of the c-DEP force levitates selected particles 5 of a mixture and blocks their progress through the chamber while allowing non-selected particles 6 to pass through to the outlet 2. In this instance the selected particles 5 are polystyrene spheres 6 μm in diameter, while the non-selected particles 6 are polystyrene spheres having diameters of 4 μm, 2 μm, and 1 μm. The horizontal component of the c-DEP force generates a force that acts in a direction along the main channel, and thus, tends to resist the motion of an approaching particle. Through appropriate arrangement of the electrodes and controlling of the voltages applied to the electrodes, it is possible to block particles of having different properties or sizes. Once non-selected particles have exited and introduction of the suspended particle mixture has ceased, the selected particles may be collected at outlet 2 by hydrodynamic flow, for example, under continuous flow conditions. It is also possible to concentrate particles having the same size and/or electrical properties for further manipulation and analysis. In addition, the horizontal component of c-DEP force also generates a net transverse force that displaces non-selected particle at different locations across the channel width.

Figure 2:
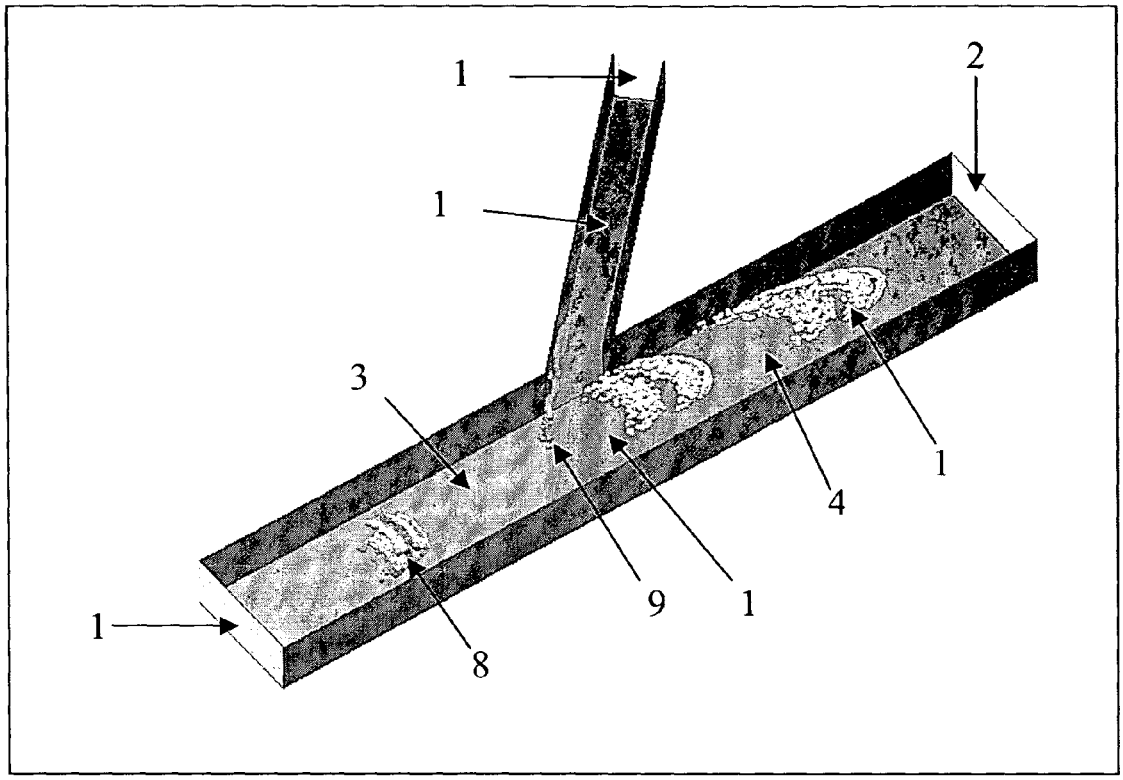
FIG. 2 depicts the separation of selected particles into a side channel.

FIG. 2 illustrates the operation of a separation chamber comprising one pair of coupled, planar, wedge-shaped electrodes 3 and 4 with parallel facing edges forming a gap 18 having a constant gap distance. A mixture of particles 8 suspended in a fluid enters the separation chamber through inlet 1. A c-DEP force generated by applying a voltage to electrodes 3 and 4 levitates and deflects selected particles 9 into the proximal end of the side channel 10 and on to the side outlet 11 at the distal end of the side channel. The opening at the proximal end of the side channel is normally positioned to overlap at least a portion of the gap between electrodes and the trailing edge of the first electrode encountered by the particles. It is preferable but not necessary to introduce the mixture of particles slightly away from the longitudinal axis of the chamber, towards a side channel, so that, when the mixture arrives at the electrodes, it will be subjected to a lateral c-DEP force that will tend to disperse selected particles in a transverse direction quickly, based on particle size and/or electrical properties. The flow of non-selected particles 12 is unaffected or directed by c-DEP forces to continue through the main channel of the separation chamber to outlet 2. The separation chamber may be tuned to separate selected particles based on their sizes or electrical properties by adjusting the gap 18 between electrodes, applied voltage, and/or the frequency of alternating applied voltage.

Figure 3:
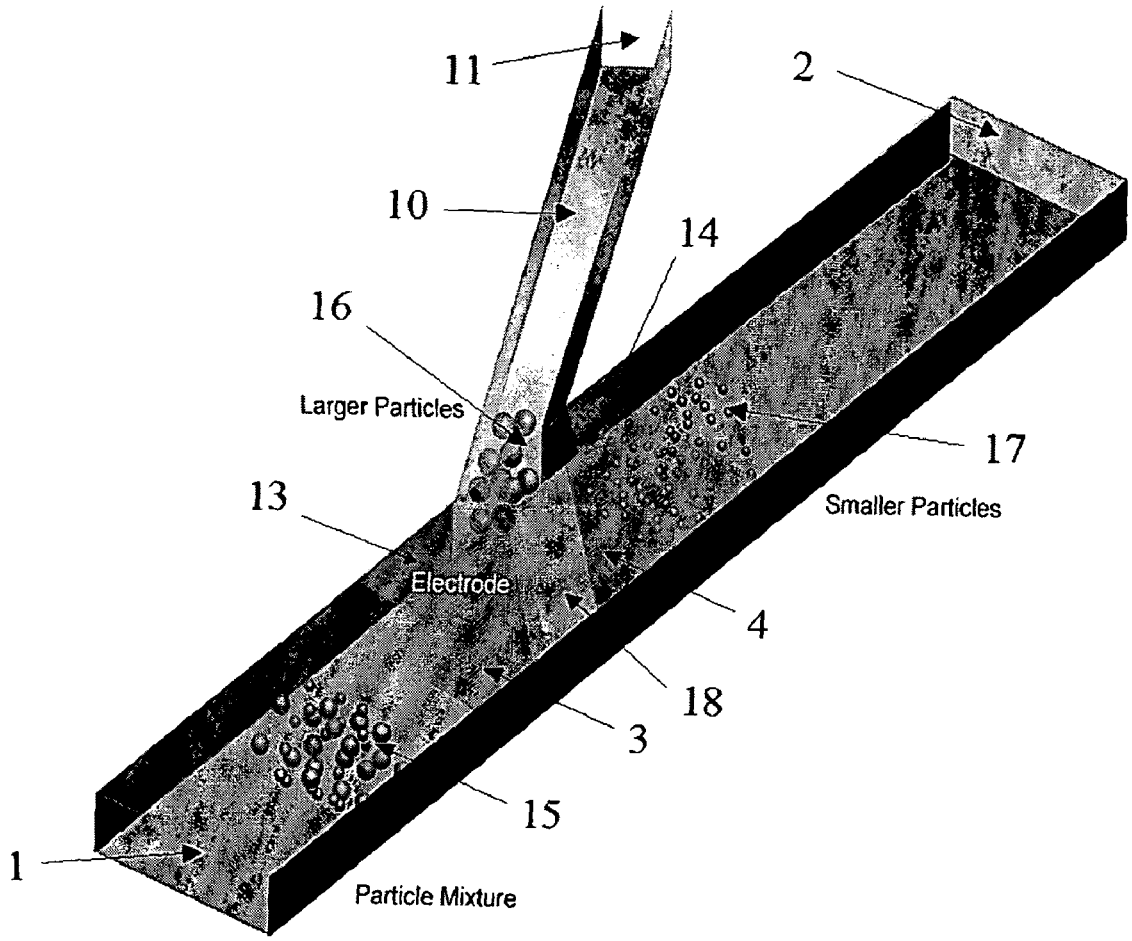
FIG. 3 is a schematic of particle separation based on particle size.

FIG. 3 Shows an embodiment of the invention comprising two pairs of opposing electrodes. Electrodes 3 and 4 are electrically coupled and form a part of the bottom of the flow channel below the fluid flow. Electrodes 13 and 14 are electrically coupled and form a part of the top of the flow channel above fluid flow and placed exactly opposite (directly above) 3 and 4. The electrodes of each coupled pair are separated by a gap 18, which is normally the same but may be different for the top and bottom pairs of electrodes. The width of the gap between electrodes can be reduced or enlarged to increase or decrease the electric field strength generated by each pair of electrodes. The figure also shows inlet 1, a mixture of particles having different sizes 15 moving through the flow channel, selected larger particles 16 moving into the side channel 10 toward side outlet 11, and smaller, non-selected particles moving through the flow channel toward outlet 2. In this instance, the larger, selected particles experience a greater levitating c-DEP force than smaller sized particles. The particles being separated need not be of different sizes but may, for example, be cells having the same or similar sizes but different electrical properties resulting from different plasma membrane surface or cellular contents. When cells are being separated or processed, the suspending liquid is normally an aqueous buffer. It is also possible to separate biological particles from non-biological particles and living cells from non-living cells using a similar approach.

Figure 4:
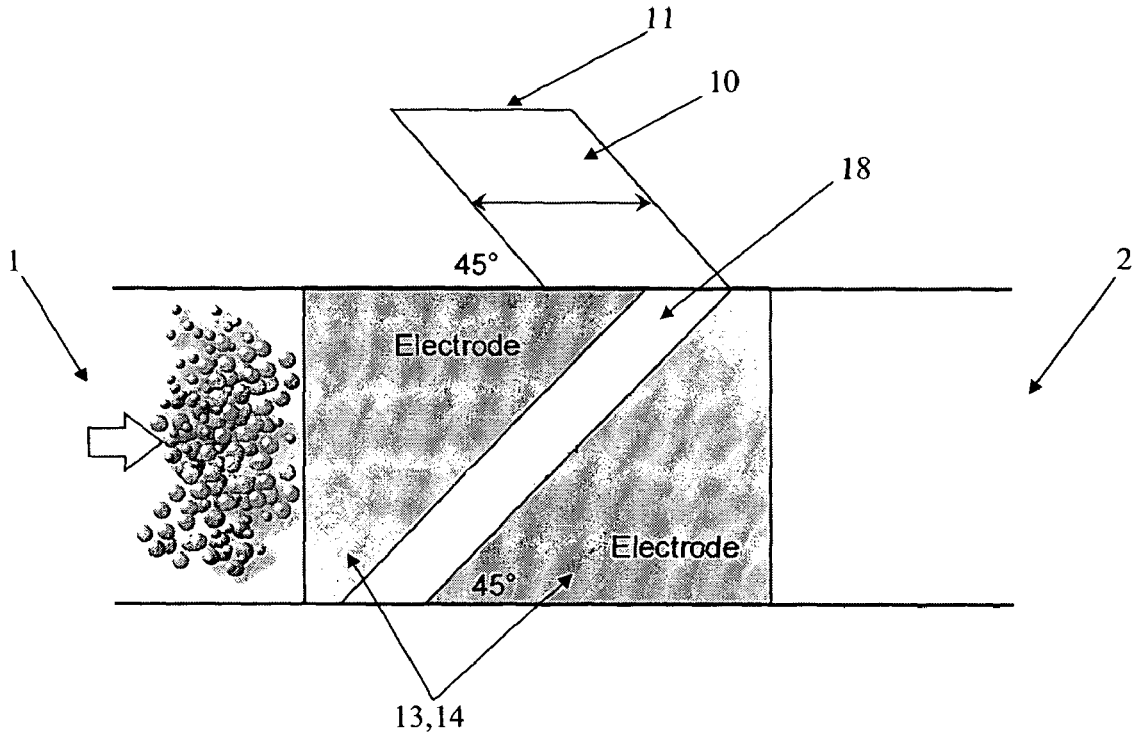
FIG. 4 illustrates one example of a separation chamber including dimensions.

FIG. 4 shows the top view of one embodiment of a separation chamber. The dimensions of the separation chamber may vary greatly depending on the particles present in the mixture being separated or concentrated. For example, main channels may have a range of heights from about 1.0 μm to 1.0 cm and a range of widths from about 1.0 μm to about 1.0 cm. The velocity of fluid approaching the electrode may be as high as 1 mm/s. Exemplary embodiments have widths and heights ranging from 10 μm to 200 μm to 400 μm 800 μm. The gap 18 between electrodes may vary between 1.0 μm and 1.0 cm with preferred embodiments ranging from 1.0 μm to 10 μm to 100 μm to 1 mm. The figure depicts only one pair of electrodes 13 and 14, but may also comprise a second, opposing pair of coupled, planar electrodes. The separation chamber may also comprise multiple side channels and multiple sets of electrode pairs for directing different selected particles into each of the side channels. The potentials applied to the electrodes may range from 0.1 to 1,000 volts.

Figure 5:
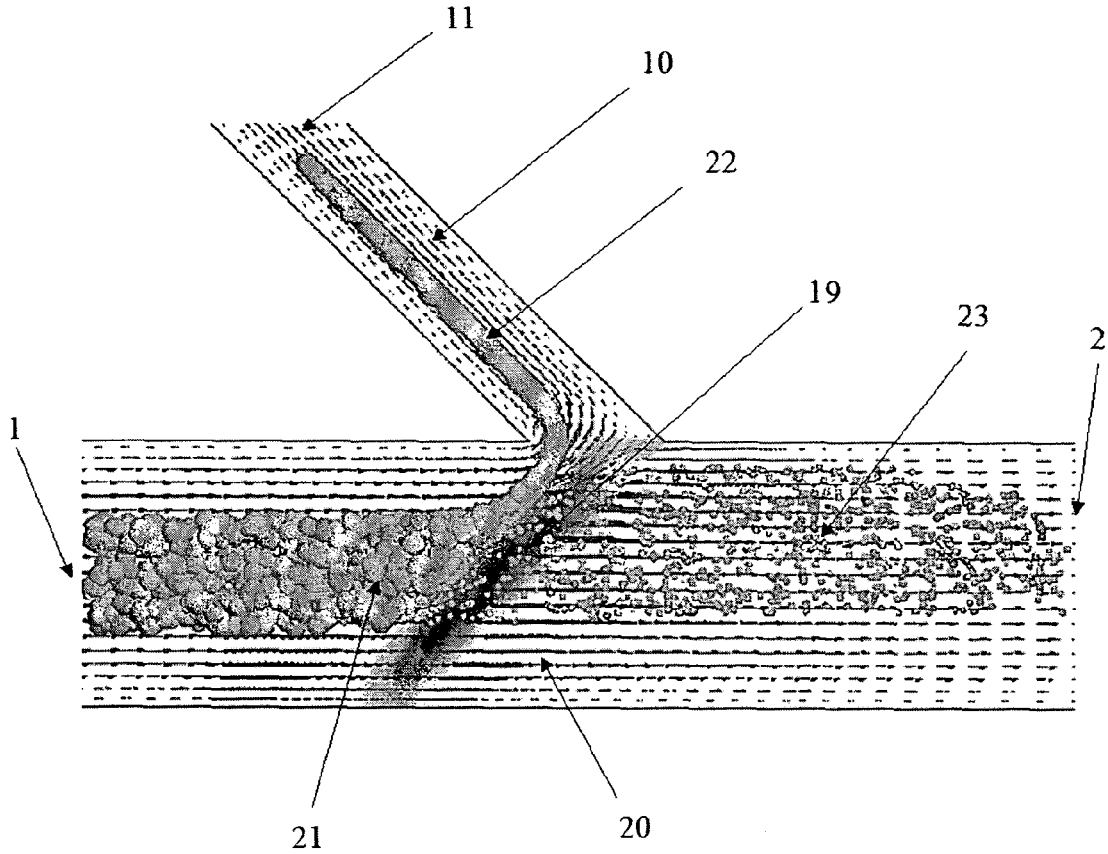
FIG. 5 illustrates the location of the electric field relative to particle separation in one embodiment of a separation chamber.

FIG. 5 shows the continuous flow operation of a separation chamber. The fluid flow patterns are illustrated by plotting planar velocity vectors through the mid-plane of the flow channel. The DEP force caused by electric field 19 (shown in filled contours) deflects the flow of selected particles 22 into side channel 10. Non-selected particles 23 continue through the flow channel toward outlet 2. In another embodiment, recycling of the particle-fluid suspension, coupled with varying the operating conditions including flow rates and electrode potentials can be performed to enhance the efficiency of separation or sequentially selecting different particles for separation.

Figure 6:
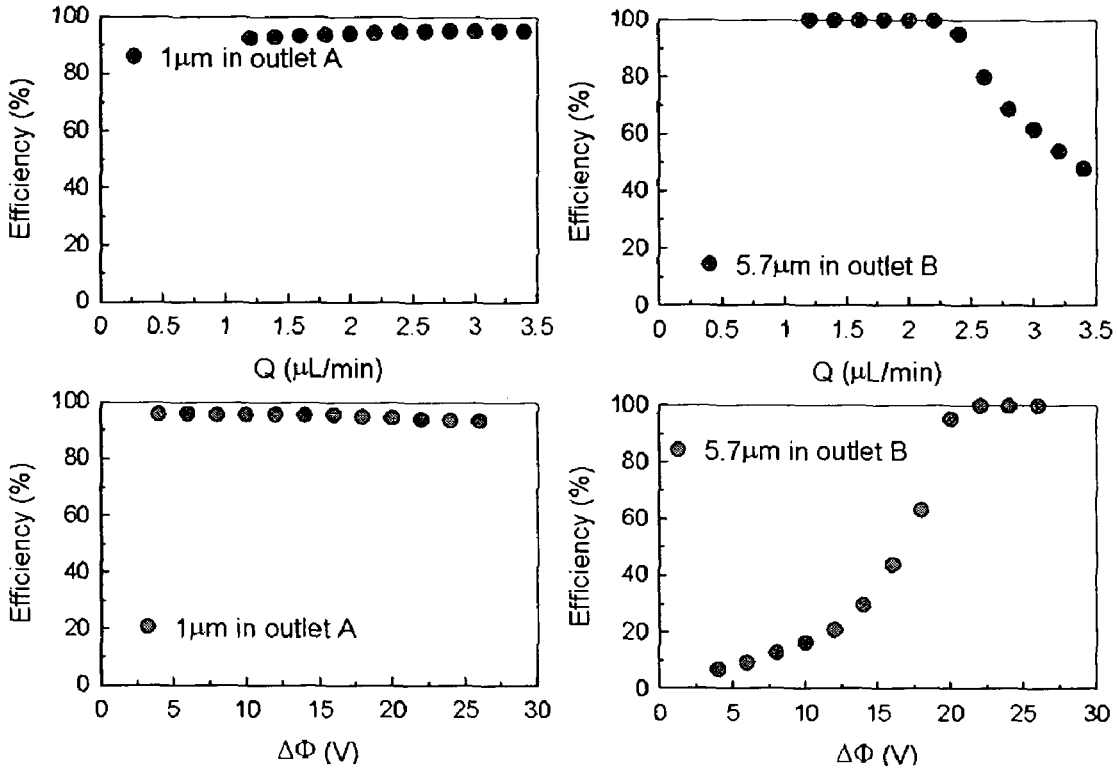
FIG. 6 shows particle separation efficiency data for one embodiment of the invention.

FIG. 6 provides sample particle separation efficiencies based on particle size, flow rate, and applied potential. Outlet A in this case is the main flow channel outlet and Outlet B is the side channel outlet. In this figure, the computed efficiency of the separation chamber for a mixture of two different particle sizes (1 and 5 μm) is shown. Under idealized conditions, Outlet A should contain 100% of the 1 μm particles whereas 100% of the 5 μm particles should exit via Outlet B upon energizing the electrodes. All of the 5 μm particles may be collected at the side outlet at sufficiently small flow rates at fixed applied electric field strength. The separation efficiency for 5 μm particles increases with an increase in electric field strength, a result of stronger DEP forces at the electrode gap at higher applied voltages. A fixed amount of 1 μm particles exit the separation chamber via Outlet B due to the presence of bifurcated flow field near the electrode gap, which exists independent of electric field. The relative insensitivity of 1 μm particle depletion to flow rate and applied voltage is evidenced by small variations in the amount of 1 μm particles in Outlet A.

Figure 7:
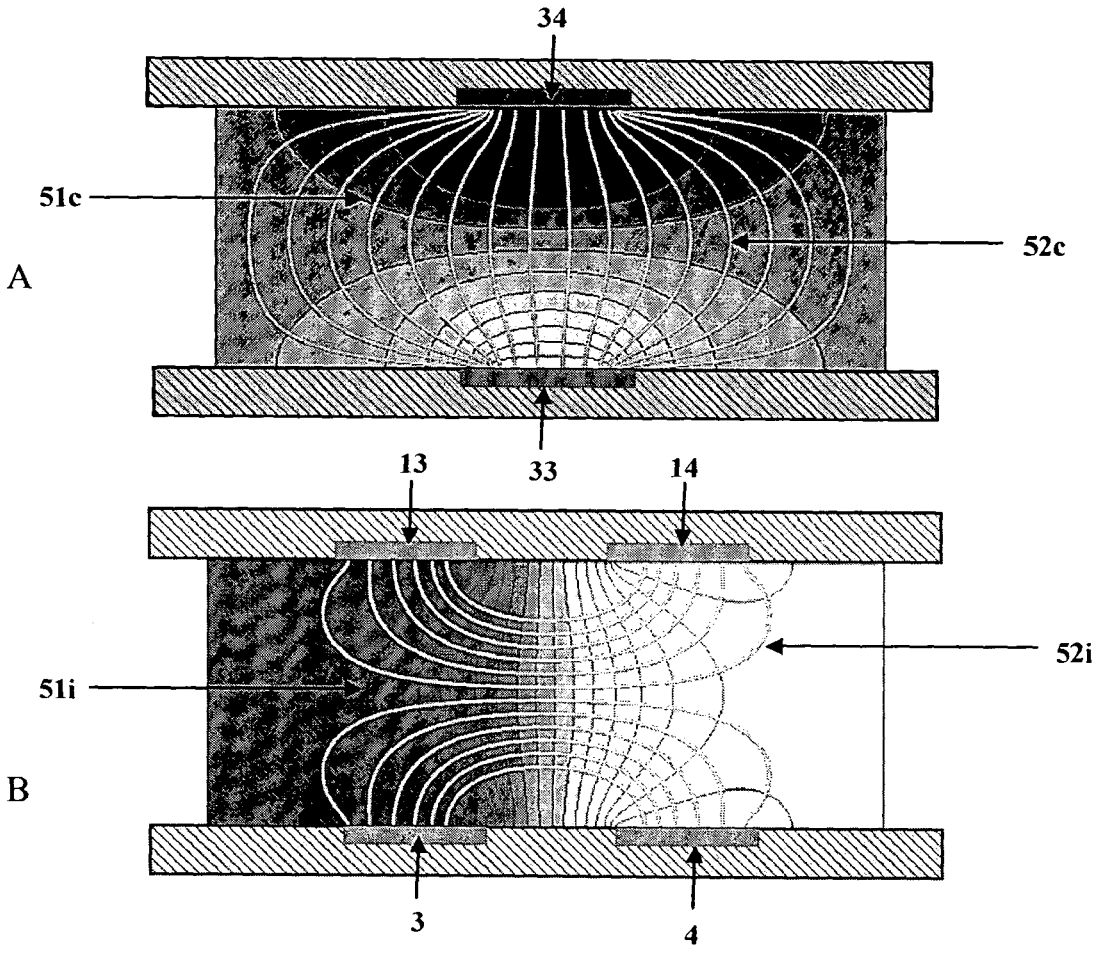
FIG. 7 illustrates the difference between the electric field geometries of the present invention and conventional DEP particle separation chambers.

FIG. 7 illustrates the differences between the electric field lines and isopotential contours generated according to the present invention and those generated in conventional DEP particle separation chambers. The present invention uses consecutive, electrically coupled electrodes that are adjacent to one another to generate electric fields as shown in B. Electrodes 3 and 4 are electrically coupled, as are electrodes 13 and 14. Previous methods use electrodes as arranged in A, where opposing electrodes 33 and 34 are electrically coupled.

The conventional electrode arrangement used, for example, by Fuhr et al. generates a pattern of electric field lines 52*c* that traverse the flow channel between them. The electrode arrangement according to the present invention generates field lines 52*i* that originate and terminate on the same side of the flow channel. The isopotential contours generated by the electrode arrangement of the present invention 51*i* and the conventional arrangement 51*c* also differ. The magnitude of the potential gradients are proportional to the spacing between isopotential lines in A and B. As a particle moves from left to right in the flow channel, it experiences a much higher potential gradient in B than it does in A. Furthermore, the gradient is symmetrical in B and asymmetrical in A, which also favors separation.

The arrangement in B, the present invention, provides several advantages over the arrangement in A. The electric field strengths in both A and B can be increased by moving the coupled electrodes closer together while applying the same constant or varying potential. Moving the coupled electrodes closer together reduces the flow channel dimensions for A but not for B. Consequently, B can operate at lower applied potentials while maintaining higher flow volumes and flow rates. The use of lower applied voltages also reduces the risk of damaging cells, viruses, and other biological particles being separated. The electric field and isopotential geometries in B cannot be produced by any combination of electrode pairs that are electrically coupled and on opposite sides of the flow channel.

The DEP force of the present invention can be adjusted by altering the electrode gap, electrode geometry, channel geometry, potential and/or frequency and/or waveform of applied potential. The flow rate determines the hydrodynamic force acting on the particles, which is strong enough for non-selected particles to overcome lateral DEP force at each set of electrodes while selected particles will be halted or diverted into one or more side channels.

Post-separation and Multi-selection Handling:

Non-selected particles in many embodiments can be further sorted by at least three different methods, which may be used alone or in combination. In the first method, the sample collected at outlet 2 in FIG. 3 can be recycled into the system via inlet 1. AC signals applied to electrodes 3, 4, 13, and 14 can be adjusted to block the next type of particle to be selected. In the second method, one may serially arrange separation chambers to receive fluid suspensions from flow channel and/or side channel outlets of upstream separation chambers. In a third method, one may modify the basic separation chamber structure to form a straight flow channel with multiple side channel outlets and multiple pairs and/or opposing pairs of electrodes. The side channels are preferably placed such that the openings of the side channels join the flow channel as to overlap gaps between electrode pairs and/or the trailing edge of the first electrode of an electrode pair. The electrode pairs, or opposing electrode pairs, would be separated by a distance sufficient to minimize electric field interactions between them. The electric fields may be adjusted so that particles having different sizes and/or electrical properties can be sorted through the side channels sequentially.

Material and Fabrication

A detailed review of common microfluidic fabrication processes can be found in Madou, Marc J. (2002) "Fundamentals of Microfabrication: The Science of Miniaturization," 2$^{nd}$ Edition by CRC Press, and Fiorini et al. (2005) *Disposable Microfluidic Devices: Fabrication, Function, and Application BioTechniques* 38:429-446.

The fabrication of microfluidic separation chambers can be accomplished using known microfabrication techniques, including wet etching, reactive ion etching, conventional machining, photolithography, soft lithography, hot embossing, injection molding, laser ablation and plasma etching. For example, elastomeric materials such as polydimethylsiloxane (PDMS) and thermoset polyester (TPE) can be used for replica molding fabrication techniques. Thermoplastic materials such as polymethylmethacrylate (PMMA), polycarbonate (PC), cyclic olefin copolymer (COC), polystyrene (PS), polyvinylchloride (PVC), and polyethyleneterephthalate glycol (PETG) can be used with embossing technique. Thermoplastics such as PC and PMMA can also be used for injection molding. PS, PC, cellulose acetate, polyethyleneterephthalate (PET), PMMA, PETG, PVC, PC, and polyimide can be used with laser ablation techniques.

The electrode material in the separation chamber can be, but is not limited to, inert metals such as gold, platinum, and palladium to prevent electrochemical reactions and bubble formation. The electrodes can be deposited and patterned to the surfaces of microchannels using common metallization techniques employed in microfabrication such as deposition, sputtering, and stamp-printing, among others.

Examples

Separation Chambers: One exemplary separation chamber is illustrated in FIG. 4 and has dimensions of 0.8 mm in width and 0.2 mm in height (normal to the view shown). The inter-electrode gap distance is 0.1 mm for both top and bottom electrode pairs. The side channel forms a 45° angle with the upstream portion of the main flow channel and is 0.2 mm in width and height. Another exemplary separation chamber is shown in FIG. 3, which has the same dimensions as the separation chamber in FIG. 4 but the side channel forms an angle of less than 45° with the downstream portion of the main flow channel.

FIG. 1 illustrates a separation chamber having no side channel and an electrically coupled pair of electrodes in the bottom surface of the flow channel. The gap between electrodes is non-uniform because the shape of the gap is a trapezoid. The separation chamber in this case 50 μm wide and 20 μm deep.

The length of any separation chamber will depend upon the number of electrode pairs it contains, the spacing between them, and the number and cross-sectional areas of side channels, for example.

Simulations

All simulations were performed using CFD-ACE+ (ESI CFD, Inc), a computational modeling software package using validated mathematical models.

FIG. 1 illustrates a simulation of particle separation by one embodiment of the invention. Polystyrene particles having diameters of 1, 2, 4, and 6 μm are introduced into the center of the flow channel inlet. The largest (6 μm diameter) polystyrene beads are blocked from flowing toward the separation chamber outlet by applying a 10 KHz AC electric field of 20 V (peak to peak) to the electrode pair. Both separation and collection can be accomplished using a single system separation chamber having no side channel by releasing the blocked particles by eliminating or adjusting the potential applied to the electrodes. Non-selected particles can be recycled to the separation chamber inlet and the electrode potential, waveform, or frequency can be adjusted to block a different set of particles.

FIG. 4 and FIG. 5 illustrate simulation results for another embodiment of the invention. The dimensions of the separation have already been described. Spherical polystyrene particles having diameters of 1 μm and 5.7 μm suspended in an aqueous buffer are introduced into the center of the flow channel inlet with an average inlet velocity of 200 μm/s. The flow rate in the channel is 2.4 μL/min through a flow channel. Two pairs of electrically coupled electrodes are located in the bottom and top surfaces of the flow channel, respectively, and are each separated by a gap distance of 140 μm. A side channel is located at the inter-electrode gap. The particles are separated by adjusting an AC potential applied to the electrodes to 17.5 V (p-p) and 10 KHz, which diverts the larger particles into the side channel while allowing the smaller particles to continue to the flow channel outlet.

Experimental Examples

A separation chamber having the same dimensions and components as described for the preceding simulation was fabricated and tested. Polystyrene beads having diameters of 1 μm and 9 μm were suspended in water and 1% BSA. Inositol was added until the density of the aqueous solution was equal to the density of the polystyrene beads. The particle suspension was introduced into the inlet of the separation chamber having a flow rate of 2.4 μL/min. The 9 μm beads were diverted into the side channel by applying an AC signal of 10 Mhz frequency and 20 V (p-p) with 180° phase shift to the electrode pairs.

Figure 8:
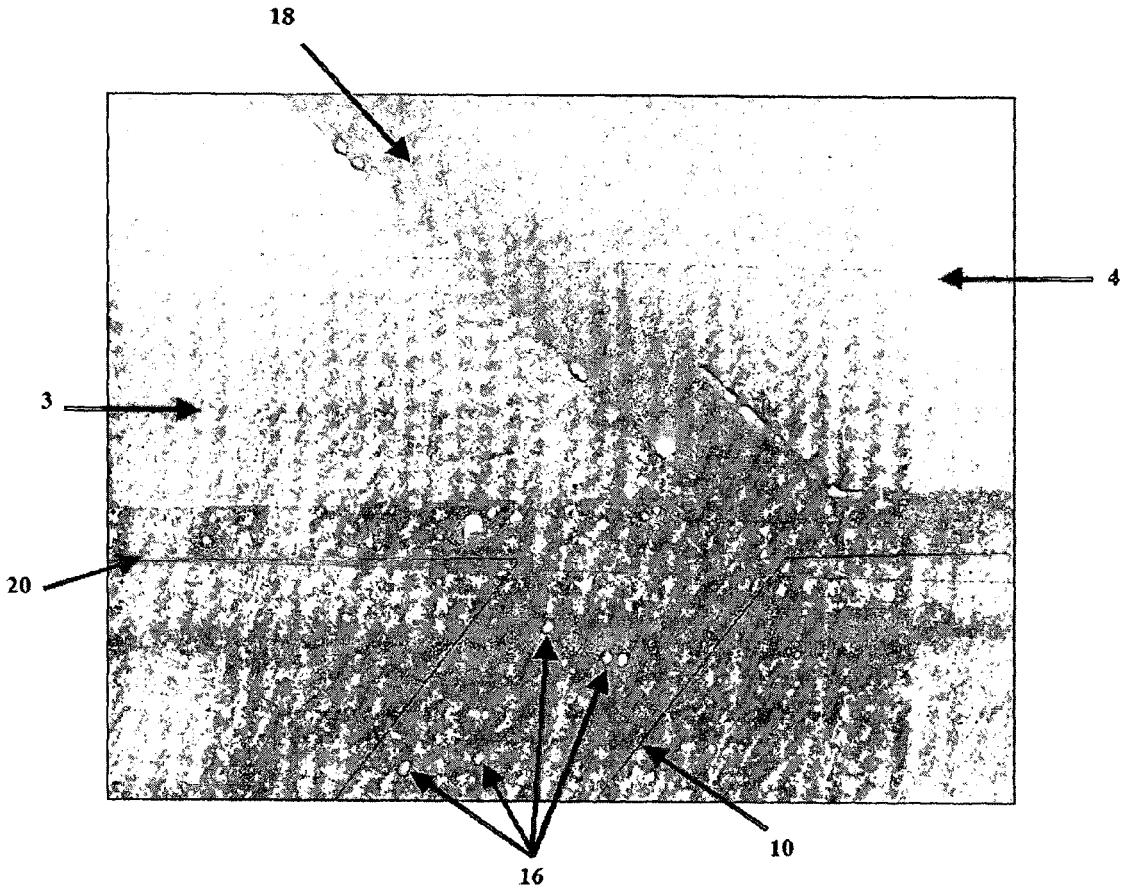
FIG. 8 shows the bottom view a separation chamber in use.

FIG. 8 shows a prototype separation chamber in use, focusing on the region around the electrodes 3 and 4 and the side channel 10. The dimensions of the separation chamber are the same as those in FIG. 4. The bottom electrode pair 3 and 4 is visible and eclipses the opposing top electrode pair. The inter-electrode gap 18 between the top pair of electrodes 3 and 4 is visible. Black lines have been inserted into the photograph to show the outline of the side channel 10 and to clearly demarcate the boundary of the flow channel 20. Fluorescent, 1 μm and 9.0 μm diameter polystyrene spheres travel down the main flow channel. At the electrode gap, selected 9.0 μm particles 22 are diverted into side channel 10 whereas 1 μm particles travel downstream in the main flow channel without being deflected significantly at the electrode gap. The fluorescent intensity from 1 μm particles is not sufficient to obtain a sharp image and are not shown. Large white spots are artifacts caused by adhesion of particulates to chamber surfaces. The electrodes of both electrode pairs in this embodiment do not completely traverse the width of the main flow channel. Diversion of the selected polystyrene spheres 22 into side channel 10 was accomplished using a 10 MHz AC applied voltage of 20 V (p-p) with 180° phase shift to both pairs of electrodes.

What is claimed is:

1. A microfluidic particle sorting apparatus comprising a separation chamber, said separation chamber comprising:

a flow channel having an inlet, an outlet, a top wall, a bottom wall, and side walls, a side channel having an inlet and an outlet, wherein the inlet is positioned in a side wall of the flow channel and the side channel is configured to carry fluid and particles away from a flow path of the flow channel to the outlet of the side channel, and a first pair of consecutive, electrically coupled, planar electrodes wherein the first pair of planar electrodes:

lie in the same plane, form a part of either the top or the bottom of the flow channel, have parallel opposing edges forming a gap between the electrodes, said parallel opposing edges being separated by a gap distance, and wherein the parallel opposing edges of the first pair of electrodes and the gap between the electrodes form an angle of about 45 degrees relative to a flow of fluid from the inlet of the flow channel to the outlet of the flow channel and the inlet of the side channel overlaps at least a portion of the gap between the electrodes.

2. The microfluidic particle sorting apparatus of claim 1, wherein the separation chamber further comprises a second pair of consecutive, electrically coupled, planar electrodes having parallel opposing edges forming a gap between the second pair of electrodes and said parallel opposing edges are separated by a gap distance wherein:

the second pair of electrodes form a part of the flow channel directly opposite the first pair of electrodes and the gap between the second pair of electrodes is parallel to and directly opposite to the gap between the first pair of electrodes.

3. The microfluidic particle sorting apparatus of claim 1 or 2, comprising more than one separation chamber.

4. The microfluidic particle sorting apparatus of claim 1 or 2, wherein the separation chamber comprises a plurality of side channels and a plurality of a first pair of consecutive, electrically coupled, planar electrodes separated by a gap distance.

5. The microfluidic particle sorting apparatus of claim 1, wherein an angle formed between the side channel and the flow channel is between 30 and 150 degrees.

6. A method for sorting a mixture of particles in a microfluidic apparatus comprising the steps of:

a) placing a liquid suspension of particles, the particles and liquid having different dielectric properties, into an inlet of a separation chamber comprising:

a flow channel having an inlet, an outlet, a top wall, a bottom wall, and side walls, a side channel having an inlet and an outlet, wherein the inlet is positioned in a side wall of the flow channel and the side channel is configured to carry fluid and particles away from a flow path of the flow channel to the outlet of the side channel, and a first pair of consecutive, electrically coupled, planar electrodes wherein the first pair of planar electrodes:

lie in the same plane, form a part of either the top or the bottom of the flow channel, have parallel opposing edges forming a gap between the electrodes, said parallel opposing edges being separated by a gap distance, and wherein the parallel opposing edges of the first pair of electrodes and the gap between the electrodes form an angle of about 45 degrees relative to a flow of fluid from the inlet of the flow channel to the outlet of the flow channel and the inlet of the side channel overlaps at least a portion of the gap between the electrodes;

b) applying an external energy source to the first pair of consecutive, electrically coupled, planar electrodes to induce an electric field gradient within the suspension in the separation chamber; and c) controlling the external energy source whereby a non-uniformity of the electric field induces dielectrophoretic forces to the particles and selectively induces at least some of the particles to flow into the side channel, thereby sorting the particles.

7. The method of claim 6, wherein the separation chamber further comprises a second pair of consecutive, electrically coupled, planar electrodes having parallel opposing edges forming a gap between the second pair of electrodes and said parallel opposing edges are separated by a gap distance wherein:

the second pair of electrodes form a part of the flow channel directly opposite the first pair of electrodes and the gap between the second pair of electrodes is parallel to and directly opposite to the gap between the first pair of electrodes.

8. The method of claim 6 or 7, wherein the liquid suspension of particles is placed into the inlet of the separation chamber in a continuous, stopped-flow, or discontinuous manner.

9. The method of claim 7, wherein an angle formed between the side channel and the flow channel is between 30 and 150 degrees.

10. The method of claim 6, wherein the external energy source is an electric field characterized by being time varying, constant direct current (DC), or an alternating current (AC) field.

11. The method of claim 10, wherein the step of controlling the external energy source comprises controlling the voltage, waveform, and frequency of the electric field.

12. The method of claim 11, wherein the step of controlling the external energy source comprises adjusting the position of the electrodes on the surface of the channel.

13. The method of claim 12, wherein the step of controlling the external energy source further comprises generating the electric field at each electrode pair in a predefined sequence.

14. The method of claim 6, wherein the step of controlling the external energy source further comprises positioning more pairs of electrodes on some of the plurality of channel surfaces as compared to other of the plurality of channel surfaces.

15. The method of claim 14, wherein the step of controlling the external energy source further comprises generating the electric field at each pair of electrodes in a predefined sequence.

16. The method of claim 15, wherein the external energy source is a time varying or constant direct current (DC) or an alternating current (AC) electric field generated between electrodes positioned within channel.

17. The method of claim 16, wherein the step of controlling the external energy source comprises controlling the voltage, waveform, and frequency of the electric field.

* * * * *